United States Patent [19]

Daniels et al.

[11] 4,322,625

[45] Mar. 30, 1982

[54] ELECTRON EMISSION REGULATOR FOR AN X-RAY TUBE FILAMENT

[75] Inventors: Herbert E. Daniels, Brown Deer; Harvey G. Randall, Oconomowoc, both of Wis.

[73] Assignee: General Electric Company, Schenectady, N.Y.

[21] Appl. No.: 164,423

[22] Filed: Jun. 30, 1980

[51] Int. Cl.[3] ..... H05G 1/30

[52] U.S. Cl. ..... 250/409; 250/421

[58] Field of Search ..... 250/401, 402, 408, 409, 250/421

[56] References Cited

U.S. PATENT DOCUMENTS

| | | | |
|---|---|---|---|
| 3,521,067 | 7/1970 | Splain | 250/402 |
| 3,916,251 | 10/1975 | Hernandez | 250/421 |
| 3,983,396 | 9/1976 | Mulleneers | 250/421 |
| 4,072,865 | 2/1978 | Craig | 250/409 |

*Primary Examiner*—Craig E. Church
*Attorney, Agent, or Firm*—Ralph G. Hohenfeldt

[57] ABSTRACT

An x-ray tube mA regulator has an SCR phase shift voltage regulator supplying the primary winding of a transformer whose secondary is coupled to the x-ray tube filament. Prior to initiation of an x-ray exposure, the filament is preheated to a temperature corresponding substantially to the electron emissivity needed for obtaining the desired tube mA during an exposure. During the preexposure interval, the phase shift regulator is controlled by a signal corresponding to the sum of signals representative of the voltage applied to the filament transformer, the desired filament voltage and the space charge compensation needed for the selected x-ray tube anode to cathode voltage. When an exposure is initiated, control of the voltage regulator is switched to a circuit that responds to the tube current by controlling the amount of phase shift and, hence, the voltage supplied to the transformer. Transformer leakage current compensation is provided during the exposure interval with a circuit that includes an element whose impedance is varied in accordance with the anode-to-cathode voltage setting so the element drains off tube current as required to cancel the effect of leakage current variations.

4 Claims, 6 Drawing Figures

FILAMENT VOLTAGE ADJUST

REF.
+V
SPACE CHARGE COMP.
LEAKAGE CURRENT COMP.
FILAMENT VOLTAGE SENSOR
+V1
V2

ELECTRON EMISSION REGULATOR FOR AN X-RAY TUBE FILAMENT

This invention is an improvement in known systems for regulating the temperature and, hence, the electron emission capability of an x-ray tube filament before and after an x-ray exposure is initiated.

As is well-known, it is often desirable to preheat the x-ray tube cathode filament so it will be ready to emit an electron beam of proper current density immediately upon applying high voltage between the anode and cathode of the tube to begin an exposure interval. Preheating the filament to a temperature where its emissivity capability is near the level required for the exposure is especially desirable when exposure intervals are very short since, without preheating, thermal lag of the filament may be so great that the proper level of emissivity may not be reached until the exposure is nearly over in which case underexposure may result.

U.S. Pat. Nos. 3,521,067, 3,916,251 and 4,072,865 disclose various systems of x-ray tube current stabilization based upon regulating the filament current in the x-ray tube prior to and during exposure. The known systems suggest use of two separate filament current regulating loops. The first loop senses and controls filament current during the preheating interval when there is no anode-to-cathode current flow, characterized as tube milliamperes (mA). The first loop will usually include means for developing one voltage signal proportional to current flowing through the filament during warmup and another voltage signal proportional to the amount by which the anode-to-cathode voltage will have to be modified during exposure to compensate for whatever space charge effect results from the filament temperature that is required to produce the desired mA when exposure is initiated. As is known, as filament temperature is increased to enable higher tube mA, more electrons come off of the cathode so it becomes more positive relative to the electron charge in the space near it in which case a higher anode voltage must be applied to compensate for the space charge effect and allow obtaining the desired tube mA. Accordingly, a signal which is proportional to the voltage that is intended to be applied to the anode is developed and it is converted to a space charge compensating signal. The space charge compensating signal, the signal proportional to desired mA and the signal proportional to the basic level of current through the filament during warmup are applied to a summing amplifier whose output signal is used to modulate a current regulator in the filament transformer primary winding circuit and hence, the filament current level during the preheating interval.

The second control loop in known systems is for regulating filament current under dynamic conditions which exist after the exposure has been initiated. Means are provided to disable the first control loop and transfer control to the second loop in response to the beginning of electron current or mA flow through the x-ray tube. This current is sensed and applied to an appropriate amplifier which causes the current regulator to maintain a constant current level through the filament which corresponds to the tube mA which has been chosen by the operator.

One of the problems which has not heretofore been satisfactorily met results from changing of the thermal and emissivity characteristics of the filament as it ages.

As indicated, in known systems, filament current sensing is used. As the tube grows older, some of the filament evaporates, thereby increasing its resistivity. With constant current and higher resistivity, filament temperature increases. Consequently, the filament is raised to a temperature above that which should be required during the exposure interval. Hence, when an exposure starts, it is necessary to quickly drop the temperature of the filament to reduce its emissivity to the level required by the tube current which has been set for the exposure. Unfortunately, there is such great thermal lag in the filament that it usually cannot be brought down to the proper temperature until part of the exposure interval has elapsed. This can result in overexposure, especially when the exposure interval is to be very short. This, in a sense, defeats the objective of the dynamic control loop which is in effect during the exposure. It also negates the validity of the tube exposure chart which is provided by manufacturers for enabling the operator to obtain the desired product of milliamperes (mA) of tube current and seconds (S), usually expressed as milliampere seconds (mAs). Moreover, when sensing and regulating filament current, as opposed to filament applied voltage, it becomes necessary for a serviceman to recalibrate the filament current setting means quite frequently.

SUMMARY OF THE INVENTION

In accordance with the present invention, the voltage applied to the primary of the filament transformer is sensed and regulated to obtain filament current control as opposed to the prior art wherein filament current has been sensed. Now, as the filament ages, its resistivity increases as with current sensing, but current necessarily decreases for a constant voltage being applied to the primary of the filament transformer in which case the filament is slightly underdriven or underheated during the preheating interval and is slightly cooler than it should be for the tube mA that is set to flow through the x-ray tube when an exposure starts. However, as a result of sensing and controlling filament voltage in accordance with the invention described herein, it becomes possible to raise the filament temperature substantially instantaneously with turn-on of the high anode-to-cathode voltage and the effects of thermal lag or the need for attempting to reduce filament temperature rapidly is obviated.

The manner in which x-ray tube mA is regulated by sensing and regulating the voltage applied to the filament transformer primary winding will now be described in greater detail in reference to the drawings.

DESCRIPTION OF A PREFERRED EMBODIMENT

Figure 1A:
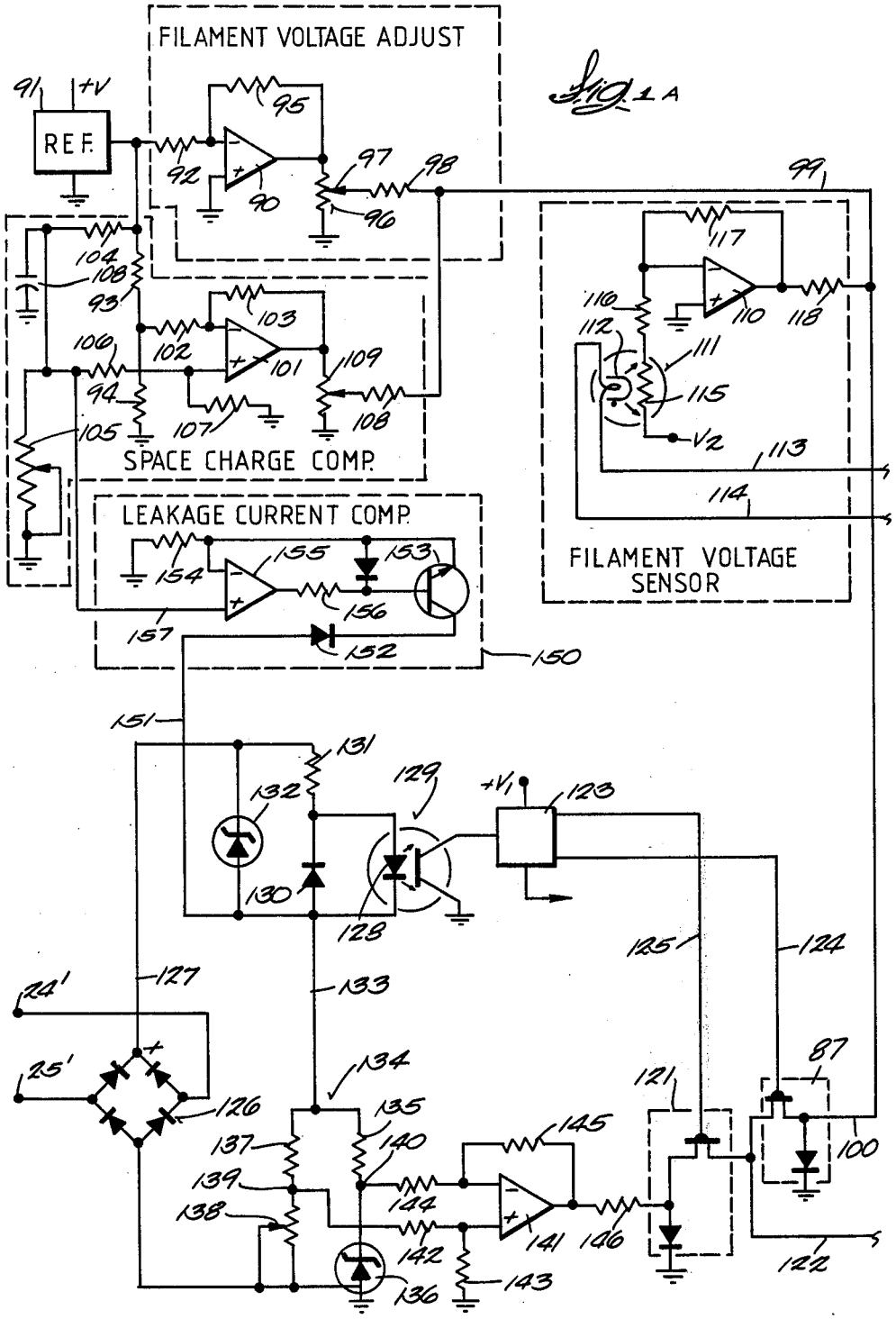
FIG. 1, composed of parts 1A and 1B, is a circuit diagram of an mA regulator constructed in accordance with the invention.
Figure 1B:
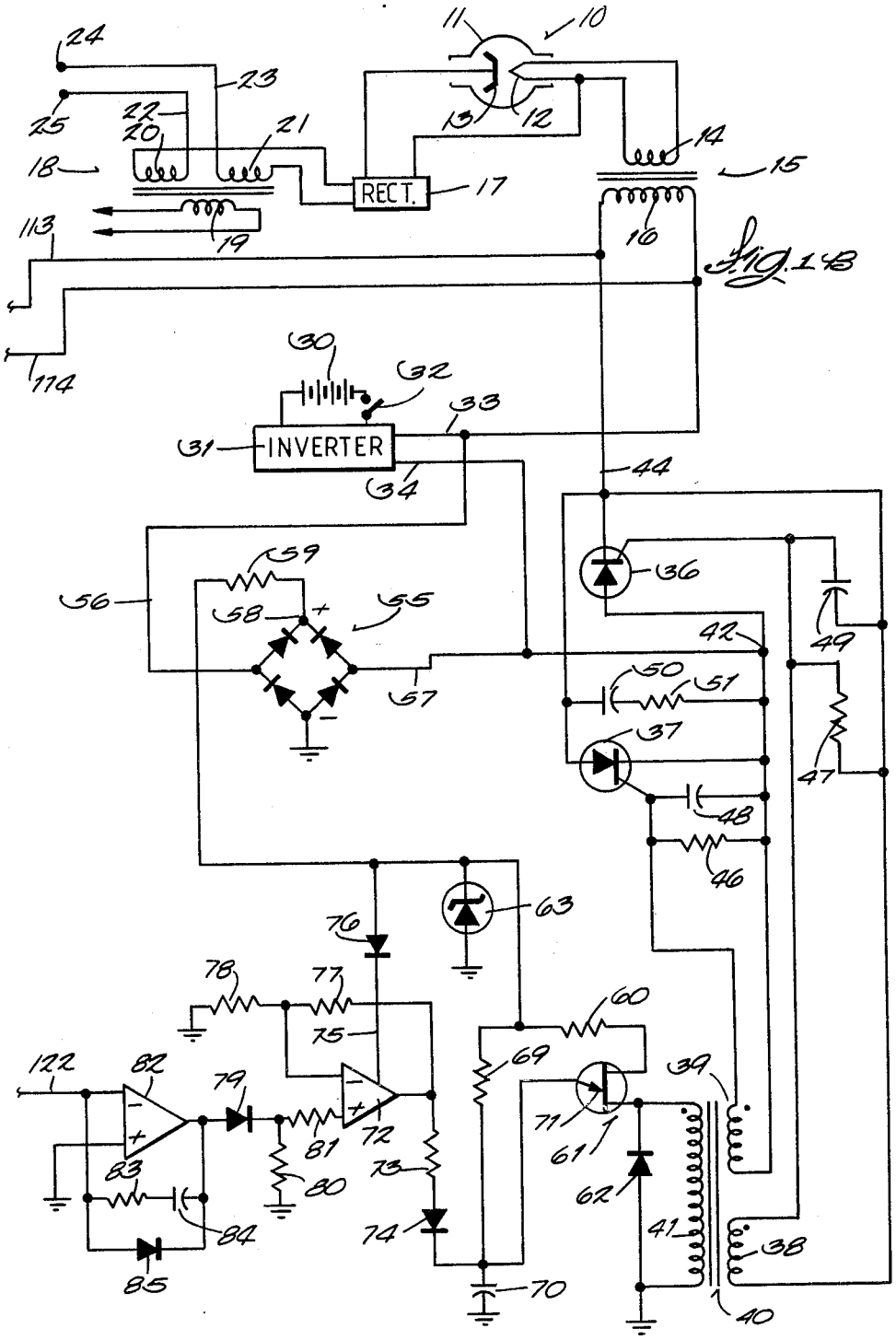

The upper right region of FIG. 1B shows an x-ray tube 10 whose filament current is subject to regulation prior to and during an x-ray exposure. The tube comprises an envelope 11 in which a hot cathode filament 12 is mounted in spaced relationship with respect to an anode target 13. The well-known induction motor means for rotating the target are not shown. Filament 12 is energized from the secondary winding 14 of a filament transformer 15 whose primary winding is marked 16. High voltage is applied during an x-ray exposure between anode 13 and filament 12 from a rectifier which is symbolized by the block marked 17. The customary high voltage transformer 18 is used. The power supply to the primary winding 19 of transformer 18 is not shown but those skilled in the art will appreciate that the primary winding may be supplied from an inverter, not shown, or from an auto transformer, not shown, which provides a range of input voltages to the transformer and, hence, a range of anode-to-cathode voltages. The high voltage secondary of the transformer consists of split windings 20 and 21 which are on a common core with the primary winding. Splitting the winding provides for two legs 22 and 23 of a loop which conducts current at a level corresponding with that flowing between the anode and cathode of the x-ray tube when the high voltage transformer 18 is energized. The loop is shown open-ended in the upper part of the drawing where its terminals are marked 24 and 25. However, it should be noted that in the lower left region of FIG. 1A there are corresponding terminals 24' and 25' to which the terminals of the loop connect. In the actual apparatus, the loop goes through an overload current protective relay, which is not shown for the sake of simplicity, before the loop closes on terminals 24' and 25'.

Figure 2:
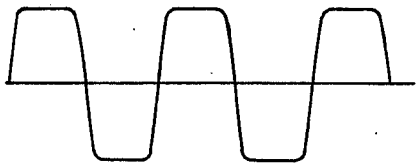
FIGS. 2–5 are waveforms which are useful for describing operation of the regulator.

The x-ray control system depicted in FIG. 1B was originally developed for a mobile x-ray unit that is powered exclusively by batteries, but it is generally applicable to x-ray apparatus supplied from alternating current power lines. In this illustration, power for driving filament transformer 15 is derived from a set of batteries marked 30 and they are connected to the input of an inverter which is symbolized by the block marked 31. There is a switch 32 in the circuit between the batteries and the inverter input. The inverter converts direct current from the batteries to alternating current having typical power line frequency such as 60 Hz. The alternating waveform on output lines 33 and 34 of the inverter is illustrated in FIG. 2 where the half-cycles are shown to be square waves substantially. Prior and during an x-ray exposure, power is supplied from inverter 31 to the primary winding 16 of filament transformer 15 through a silicon controlled rectifier (SCR) phase control circuit which includes SCRs 36 and 37 that conduct alternately for each half-cycle as will be discussed in more detail later. These SCRs are effectively in series with primary winding 16 of the filament transformer. The gates of SCRs 36 and 37 are controlled from secondary windings 38 and 39 of a pulse transformer 40 whose primary winding is marked 41. One may see that output line 33 from the inverter 31 connects directly to one side of filament transformer primary winding 16 and the other output line 34 from inverter 31 connects to a junction point 42 in the SCR circuit. The power level to primary winding 16 is controlled by controlling the phase or conduction angle of the SCRs. The SCRs are connected back-to-back, that is, in inverse parallel, to allow current flow through filament transformer primary winding 16 during alternate half-cycles in a known fashion. When a pulse is received on the primary 41 of pulse transformer 40, both of its secondary windings 38 and 39 will have a voltage developed on them but only that SCR 36 or 37 whose gate is turned on and whose anode is positive at the time will conduct. For instance, if junction point 42 becomes positive and a signal is applied from pulse transformer, secondary winding 38 by way of line 43 to the gate of SCR 36, it will conduct in the positive direction from junction point 42 through line 44, primary 16 and back to the inverter by way of line 33. During the next half-cycle, junction point 42 becomes negative and line 33 from the inverter becomes positive in which case current will flow in the opposite direction through primary winding 16 back to line 44, which is now positive, and to the anode of SCR 37 whose current will return to the inverter by way of line 45, junction point 42 and line 34. SCR 36 and SCR 37 conduct in response to signals applied to their gates from pulse transformer secondary windings 38 and 39, respectively. The triggering signal for the gate of SCR 37 is developed across a resistor 46 and the signal for firing SCR 36 is developed across a resistor 47. Capacitors 48 and 49 simply provide some filtering for the gates. Further filtering is supplied by series connected capacitor 50 and resistor 51.

Means must be provided for rendering SCRs 36 and 37 conductive alternately in synchronism with alternate half-cycles of the alternating waveform depicted in FIG. 2. This is accomplished with a full wave rectifier 55 whose alternating current input lines 56 and 57 are connected to output lines 33 and 34, respectively, of inverter 31. The output waveform appearing between positive output terminal 58 of rectifier 55 and the opposite ground terminal is depicted in solid lines in FIG. 3 which shows it to be full wave rectified. The rectified DC is fed through a circuit including resistors 59 and 60 and a unijunction transistor 61 which feeds current pulses through primary winding 41 of pulse transformer 40 to ground. A diode limiter 62 is connected between the output terminal of unijunction transistor 61 and ground. It will be evident that current flow through primary winding 41 of transformer 40 is unidirectional. Peak voltage applied to the unijunction transistor 61 load circuit is limited by a zener diode 63.

Unijunction transistor 61 is used to control the power applied to filament transformer primary winding 16 during preheating of the filament and during an exposure interval by controlling the conduction angle of SCRs 36 and 37. For instance, if the unijunction is triggered at some point in the rectified half cycle such as the point marked 64 in FIG. 3, a pulse represented by the shaded area 65 will pass through primary winding 41 and produce a gate firing pulse which will cause one of the SCRs to conduct over an angle or width corresponding with pulse 66 in FIG. 4. During the next half cycle, assuming power requirements of the filament transformer remained constant, the unijunction would fire again at the point marked 67 which corresponds with the point in time marked 64 in FIG. 3 and the conduction angle of the alternate SCR would be represented by the pulse 68 in FIG. 4. It will be evident to those skilled in the art that the power applied to filament transformer primary 16 will depend on controlled variations of the width or conduction angle of the SCRs as represented by the pulses 66 and 68 and this will in turn depend upon the point at which unijunction transistor 61 is triggered during each half-cycle. Double-headed arrows on typical pulses 66 and 68 are used to indicate that the rise of the pulses will shift in correspondence with power requirements of the filament.

Figure 3:
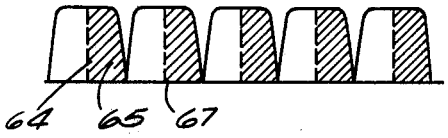
Figure 4:
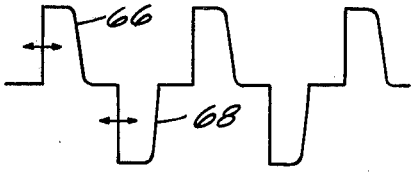

There are two control loops which control the voltage level on the unijunction timing capacitor 70 and thereby set the point at which unijunction transistor 61 is triggered during each half-cycle of a-c waveform of inverter 31. One loop is effective to control the voltage applied to the primary of the filament transformer 16 during the filament preheating interval and the other loop is active to control filament voltage during an x-ray exposure. The unijunction timing circuit includes a resistor 69 which is supplied from full wave rectifier terminal 58 with rectified pulses such as are depicted in FIG. 3 in solid lines. Resistor 69 connects to timing capacitor 70 which goes to ground. As is typical of unijunction RC timing circuits, when the voltage on capacitor 70 reaches a certain level, the gate 71 voltage rises correspondingly and causes the unijunction to conduct through the primary winding 41 and produce the pulses for triggering the SCRs 36 and 37 as previously discussed. The time constant of the RC timing circuit is short enough for triggering to occur within each half-cycle of the rectified waveform as in FIG. 3 and necessarily in synchronism with corresponding successive half-cycles which are conducted alternately by SCRs 36 and 37. In the circuit shown here, the point in time or phase at which the unijunction transistor 61 is triggered in each half-cycle is varied automatically as required to hold the voltage applied to the filament transformer primary 16 and secondary 14 constant at whatever value has been preselected. This results from the width of the pulses being varied as illustrated in FIG. 4.

The triggering voltage on capacitor 70 is also varied to set the voltage on the filament transformer in either mode of operation, that is, when the control loop for preheating the filament is active or when the loop for regulating x-ray tube current during an exposure is active as will be explained. For this purpose, a noninverting amplifier 72 has its output connected to a circuit which includes a resistor 73 and a diode 74 which feed to timing capacitor 70. Amplifier 72 is energized through a line 75 which has a diode 76 in it. The anode of the diode is connected to zener diode 63. Amplifier 72 has a feedback resistor 77 and an input resistor 78 which connects to ground. The input signal to the noninverting terminal of amplifier 72 is fed through a diode 79 and developed across resistor 80. Resistor 81 is the noninverting input resistor. The input signal to amplifier 72 comes from the output of an inverting high gain integrating amplifier 82. This amplifier has a feedback and integrating circuit consisting of a resistor 83 and a capacitor 84. There is a diode 85 also connected between the input and output of this amplifier. The input to amplifier 82 comes from one or the other of the filament preexposure or preheating control loop and from the control loop which is in effect during an exposure. These control loops will now be examined to demonstrate how they alternately make a contribution to the voltage level on the unijunction timing capacitor 70.

As indicated earlier, during preheating or preexposure, the x-ray tube filament voltage is regulated in response to the summation of a voltage which is proportional to instantaneous filament voltage, another that is proportional to the amount of space charge compensation that is required, and another that is proportional to the desired filament current. The sum of these voltages is applied to the inverting input of amplifier 82 through a switching field effect transistor 87 which is designated by a dashed rectangle. When this transistor is turned on, the sum of the various voltages just mentioned is applied through it to the input of amplifier 82 by way of line 122.

In the upper left of part A of FIG. 1, the circuit for selecting or adjusting the filament voltage to a selected level and producing a voltage proportional to the setting is shown. It consists of an operational amplifier 90 which has its inverting input connected to a stable reference voltage source 91 through an input resistor 92. The reference voltage is applied to the top of a voltage divider consisting of series connected resistors 93 and 94. The amplifier has a feedback resistor 95. The output of this amplifier, which is fed through a variable resistor 96, is constant. A signal proportional to desired filament current is obtained on the wiper 97 of adjustable resistor 96. This signal is conducted through a limiting resistor 98 to a summation line 99 which connects to the input terminal 100 of field effect transistor (FET) 87.

A voltage signal that is proportional to the amount of space charge compensation required is developed with a circuit including an amplifier 101. It has an input resistor 102 and a feedback resistor 103. Input resistor 102 obtains the reference voltage from voltage divider 93, 94. There is another divider consisting of resistor 104 connected in series with adjustable resistor 105. The value of adjustable resistor 105 should be understood to be set by turning the selector switch, not shown, which selects the voltage to be applied through the autotransformer, not shown, to the primary winding of high voltage transformer 18 which supplies the anode-to-cathode circuit of the x-ray tube 10. The input to amplifier 101 includes biasing resistors 106 and 107 and a filter capacitor 108. As indicated, the resistance and hence, the voltage developed across adjustable resistor 105 is proportional to the kilovoltage applied to the x-ray tube during exposure. A signal which is proportional to this value is outputted by amplifier 101 to develop a voltage across a potentiometer 109 which enables providing a portion of the signal through a resistor 108 to the summing line 99 and, hence, to the input terminal 100 of FET 87.

The signal which is proportional to the present voltage on the primary winding 16 of filament transformer 15 and, hence, the voltage which is applied to the filament 12 in the x-ray tube is developed with an amplifier 110 and an optoisolator 111. This isolator contains an incandescent lamp 112 which, by way of lines 113 and 114 connects across the primary winding 16 of filament transformer 15. The incandescent lamp light output varies in direct porportion to the root mean square (RMS) voltage on the filament transformer primary winding. The light radiated from incandescent lamp 112 controls the resistivity of a photoconductor resistor 115 which connects to the power supply as shown at one end and is in series with a limiting resistor 116 that connects to the inverting input of amplifier 110. This amplifier also has a feedback resistor 117 and an output resistor 118 through which it is connected to summing line 99.

Figure 5:
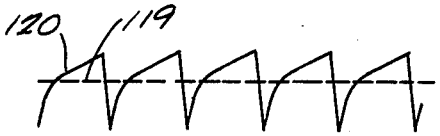

During the preexposure or filament preheating interval, FET 87 is maintained in a conductive state so that the summation voltage resulting from the three control factors, namely, the filament voltage adjust signal, the space charge compensating signal and the actual voltage on the filament transformer, is supplied to the summing inverting input of amplifier 82. After passing through amplifier 72, this signal is caused to set the charge or voltage on unijunction timing capacitor 70 at a level slightly below the triggering voltage level of the unijunction transistor 61. The voltage which is maintained on timing capacitor 70 is designated as a pedestal voltage which is represented by the level of the dashed line 119 in FIG. 5 which shows the voltage waveform for the unijunction transistor in solid lines. The pedestal will go up or down slightly in response to a variation in any one of the summed factors fed through FET 87 and keep the unijunction transistor near triggering level. The ramp voltage 120 which is built on top of the pedestal in FIG. 5 results from the cyclic charging through resistor 69 of timing capacitor 70 as was described earlier. As a result of the pedestal or constant d-c level prevailing on capacitor 70, only a small increase in the ramp 120 is required to cause the unijunction transistor to trigger which means that it can be triggered very early in each half-cycle if desired. Without the constant d-c level or pedestal, the ramp would start from a very low level each time the timing capacitor discharged and triggering could only occur near or even after half of the cycle time had passed.

The other control loop for regulating x-ray tube current in real time instantaneously with initiation of an exposure interval and during this interval, will now be described. As soon as an exposure starts, it is necessary to transfer filament voltage regulation from the control loop just described to the real time control loop. For this purpose, a second switching FET 121 is provided. Its output is connected to the input line 122 to amplifier 82 as is the output from FET 87. A switching circuit, symbolized by the block 123, is provided. This circuit has two output lines, one of which 124 connects to the gate of FET 87 and the other of which 125 connects to the gate of FET 121. When the switch is made from preexposure control to dynamic exposure control, signals from switching circuit 123 cause FET 87 to turn off and FET 121 to turn on for supplying the control signal to the input of amplifier 82.

The signal which causes switching circuit 123 to operate upon initiation of an exposure depends on current beginning to flow between the anode 13 and cathode filament 12 of the x-ray tube. As explained earlier, this current, in terms of mA, is conducted through a loop which joins with terminals 24' and 25' in the left region of part A of FIG. 1. The loop constitutes the input to a full wave rectifier bridge 126 whose output line 127 supplies a light emitting diode 128 in an opto-isolator 129. When tube current begins to flow through rectifier 126, light emitting diode 128 activates the transistor in the isolator which, in turn, controls switching circuit 123 in such manner that its output signals result in FET 87 turning off and FET 121 turning on. A reverse biased diode 130 in series with a low value resistor 131 provides the voltage drop for driving the light emitting diode 128 in the opto-isolator. A zener diode 132 acts as a voltage limiter.

When x-ray tube current begins to flow to rectifier bridge 126 and the opto-isolator diode 128, it continues by way of line 133 to a resistor bridge 134 and then to ground.

Bridge 134 acts as an error detector. It has two legs. One leg comprises a resistor 135 in series with a zener diode 136. The other leg is comprised of a resistor 137 in series with an adjustable resistor 138. When x-ray tube current flows through the two legs, a differential signal is developed between their midpoints 139 and 140. Adjustable resistor 138 is adjusted in accordance with the x-ray tube mA which is desired after the exposure begins. When both legs are equal, mA is correct. The differential signal between points 139 and 140 in error detector bridge 134 is fed to a differentially connected amplifier 141. Series connected resistors 142 and 143 provide a divider whose midpoint is connected to the noninverting input of amplifier 141. An input resistor 144 is in series with the inverting input of amplifier 141. The amplifier is provided with a feedback resistor 145 and an output resistor 146.

As indicated earlier, when x-ray tube current begins to flow, FET switch 121 turns on at the start of an exposure and the output signal from differential amplifier 141 is fed directly, by way of line 122, to the input of amplifier 82. As explained earlier, there is further signal processing in the next amplifier 72 whose output signal establishes the pedestal voltage on timing capacitor 70 for the unijunction transistor 61 during the exposure interval.

A unique feature of the present circuit and one which improves x-ray tube current control precision is a circuit for compensating for leakage current in the high voltage x-ray transformer 18 in accordance with the kilovoltage that is applied to the x-ray tube. The leakage current compensation circuit is in the left region of part A of FIG. 1 and is generally designated by the reference numeral 150. A line 151 connects into the x-ray tube mA loop in the opto-isolator circuit as shown for bleeding off a small amount of tube current in accordance with the voltage applied to the high voltage transformer 18. This current flows through a diode 152 and the collector to emitter path of a transistor 153 to ground by way of a resistor 154. Transistor 153 acts as a variable impedance. Conductivity of transistor 153 is regulated by an operational amplifier 155 which has an emitter biasing resistor 156 in its output. A signal that is proportional to the kilovoltage which is to be supplied between the cathode and anode of the x-ray tube during an exposure is fed to the noninverting input of amplifier 155 by way of line 157. This line connects to the top of adjustable resistor 105 which, as explained earlier, has a voltage developed across it which is proportional to the voltage at which the x-ray tube is set to operate during an exposure. As was explained earlier, a signal developed across adjustable resistor 105 goes up as the tube voltage setting increases as was required for space charge compensating and this meets the requirements for leakage current compensation as well. Thus, when more leakage current compensation or subtraction from x-ray tube current is required, amplifier 155 drives transistor 153 harder and more current is drained off through transistor 153.

Although what is considered to be a preferred embodiment of the invention has been described in detail, such description is to be considered illustrative rather than limiting, for the invention may be variously embodied and is to be limited only by interpretation of the claims which follow.

We claim:

1. In x-ray apparatus including an x-ray tube having a filament and an anode, a filament transformer having a primary winding a secondary winding across which the filament is connected, a high voltage transformer having a primary winding and a secondary winding connected for applying a high voltage between said anode and filament during an x-ray exposure, said last named secondary winding providing a loop circuit through which tube current between the anode and filament flows, a circuit for controlling the emission capability of said filament before and during an x-ray exposure to thereby regulate said tube current during an exposure comprising:

a voltage regulator having input means for being supplied from a voltage source and output means for applying alternating voltage to the primary winding of said filament transformer and means for controlling said regulator, means for sensing the RMS value of the voltage applied to said primary winding continuously during preexposure and exposure intervals and means responsive to the sensed voltage by producing a first d-c voltage signal proportional to said sensed voltage, means for producing a second d-c voltage signal proportional to the current desired through said secondary winding and said filament for preheating said x-ray tube filament during the preexposure interval, means for producing a voltage signal proportional to the high voltage which is to be applied between said x-ray tube anode and filament during an exposure and means for producing a third d-c voltage signal corresponding with the last named voltage signal, summing means having input and output means, a circuit including a first switching device that is in a conductive state during a preexposure interval for applying said first, second and third voltage signals to the input means of said summing means, said summing means being operative to produce a signal to which said means for regulating responds by regulating said voltage source and, hence, the voltage applied to said filament transformer primary winding, means for producing a signal representative of the magnitude of the tube current desired in said loop circuit and between said anode and filament during an exposure and for producing a signal representative of the magnitude of the tube current that is flowing after high voltage is applied to initiate an exposure, means for producing an output signal representative of the difference between said signal magnitudes, a circuit including a second switching device that is in a nonconducting state during said preexposure interval, said circuit being connected for applying said output signal to the input means of said summing means for it to provide the signal to which said regulating means responds by regulating said filament transformer voltage, and means responsive to current flow through said x-ray tube by switching said first switching device to a nonconductive state and said second switching device to a conductive state.

2. The apparatus as in claim 1 including means for compensating tube current during an exposure for the effect of the variability of high voltage transformer leakage current with the voltage applied to the primary winding of said transformer, said means for compensating comprising:

a circuit including a variable impedance device connected to said loop circuit which conducts the tube current to enable draining off a portion of said tube current to correct it for the leakage current effect, and means responding to said signal that is proportional to the voltage to be applied to said transformer during an exposure interval by altering the impedance of said variable impedance device to thereby control the amount of tube current drained off.

3. The apparatus as in claim 1 wherein said means for sensing the RMS voltage on the primary winding of said filament transformer comprises an incandescent lamp connected across said primary winding and a photoconductive element optically coupled to said lamp for providing a signal proportional to the voltage on said lamp.

4. The apparatus as in any of claims 1, 2 or 3 including:

an inverter having an input for being supplied from a d-c source and having an output, said inverter being operative to produce a substantially square wave alternating output voltage waveform, said filament transformer voltage regulating means including rectifier means having an input for said alternating waveform and having an output, said rectifier means being operative to supply rectified d-c substantially square pulses to its output, a unijunction transistor having a load circuit and a gate electrode, a triggering circuit for said unijunction transistor including resistor means connected to the output of the rectifier means and a capacitor in series with the resistor means, said unijunction gate electrode being connected to a point between said resistor means and capacitor, said capacitor being supplied with consecutive rectified pulses for developing a voltage ramp for each pulse, a pulse transformer having its primary winding connected in a series circuit including said unijunction transistor load circuit, said series circuit being connected across the output of said rectifier means, said transformer having a pair of secondary windings, means for coupling a signal to said capacitor corresponding with said summed signals when said first switching device is in a conductive state during a preexposure interval and for coupling a signal to said capacitor corresponding with the magnitude of x-ray tube current flowing during an exposure interval when said second switching device is in its conductive state to thereby develop a variable pedestal voltage on said capacitor to which said ramp voltage is added during each half-cycle of said rectified waveform, a pair of controlled rectifiers each having a gate electrode connected in circuit with the respective secondary windings of said pulse transformer and each having a load circuit connected in series with said filament transformer primary winding and said inverter output for conducting alternate half-cycles in reverse directions through said winding in phase with the corresponding rectified half-cycles fed to said timing capacitor, the point within each half-cycle at which conduction begins depending on the sum of the pedestal and ramp voltages existing on said unijunction triggering circuit capacitor during the half-cycle.

* * * * *